US005837430A

United States Patent [19]

Miyazawa et al.

[11] Patent Number: 5,837,430

[45] Date of Patent: Nov. 17, 1998

[54] IMAGE FORMING METHOD

[75] Inventors: Kazuhiro Miyazawa; Shigeo Tanaka, both of Hino, Japan

[73] Assignee: Konica Corporation, Japan

[21] Appl. No.: 874,216

[22] Filed: Jun. 13, 1997

[30] Foreign Application Priority Data

Jun. 17, 1996 [JP] Japan ..... 8-155353
Apr. 1, 1997 [JP] Japan ..... 9-082804

[51] Int. Cl.[6] ..... G03C 7/407

[52] U.S. Cl. ..... 430/373; 430/414; 430/418; 430/943

[58] Field of Search ..... 430/373, 414, 430/418, 943

[56] References Cited

U.S. PATENT DOCUMENTS

| | | | |
|---|---|---|---|
| 4,954,425 | 9/1990 | Iwano | 430/373 |
| 5,215,875 | 6/1993 | Matejec et al. | 430/373 |
| 5,629,139 | 5/1997 | Twist | 430/414 |

FOREIGN PATENT DOCUMENTS

| | | |
|---|---|---|
| 0616255 | 9/1994 | European Pat. Off. . |
| 0718686 | 6/1996 | European Pat. Off. . |

OTHER PUBLICATIONS

European Search Report EP 97 30 4154 and Annex Aug. 1997.

*Primary Examiner*—Hoa Van Le
*Attorney, Agent, or Firm*—Jordan B. Bierman; Bierman, Muserlian and Lucas

[57] ABSTRACT

An image forming method using a silver halide photographic light-sensitive material is disclosed The image forming method comprises the steps of (1) imagewise exposing to light a silver halide photographic material comprising a support having thereon a photographic layer including a yellow image forming silver halide emulsion layer, a magenta image forming silver halide emulsion layer and a cyan image forming silver halide emulsion layer, and (2) developing the silver halide photographic light-sensitive material with an amplifying development, in which silver halide grains contained each of the color forming layers have a silver chloride content of not less than 80 mole-%, and the number of silver halide grains per unit area in the magenta silver halide emulsion layer is larger than that in the yellow image forming silver halide emulsion layer and that in the cyan image forming silver halide emulsion layer, and the number of silver halide grains per unit area in the magenta image forming silver halide emulsion is 1.5 to 2.1 times of that in the cyan image forming silver halide emulsion layer, and the total amount of silver halide in the color forming layers is within the range of from 0.01 $g/m^2$ to 0.15 $g/m^2$ in terms of silver.

9 Claims, No Drawings

IMAGE FORMING METHOD

FIELD OF THE INVENTION

The present invention relates to a method for forming an image by amplifying developing a silver halide photographic light-sensitive material, by which a visual coarseness of the printed image and a variation of gradation balance depending on the time of an amplifying development are improved.

BACKGROUND OF THE INVENTION

A silver halide photographic light-sensitive material, is widely used since which has excellent characteristics such as a high sensitivity and an excellent gradation in comparison with other materials for printing. An image forming method by processing a silver halide light-sensitive material by an amplifying development has been known as a method which is preferred from the view point of effective utilization of resources. By applying the amplifying development, the amount of silver halide in the light-sensitive material can be reduced and the desilvering process of the light-sensitive material can be shortened or omitted without loss of the above-mentioned merits of the silver halide light-sensitive material. An example of the amplifying development, a method has been known by which an image dye is produced by reacting a coupler and an oxidation product of a color developing agent which is formed by an oxidizing agent such as hydrogen peroxide or a cobalt(III) complex in the presence of developed silver as a catalyst.

Generally, it has been well known that the graininess of a negative image largely influences on the graininess of the printed image when information of an image is printed on a photographic paper by enlarging projection. However, in the case of that a photographic paper having a small coated amount of silver halide is processed by the amplifying development, the influence of the graininess ot the nagative image on a visual coarseness of printed image is reduced in proportion as the reduction of the coated amount of silver halide, and the influence of the graininess of the photographic paper on the visual coarseness of printed image is increased. Consequently, the graininess tends to be degraded in the image forming method using the amplifying development, and the visual coarseness of the printed image tends to be increased when a gray image is reproduced since the formation mechanism of the graininess is different from that in a usual photographic system. It is demanded to improve such the problem.

In a usual color developing process, there is a period after a certain developing time for forming a sufficient maximum density, in which the characteristic curve of a light-sensitive material is slightly shifted parallel and increasing in the minimum density is inhibited within a slight degree. Accordingly, a preferred properties of a printing material can be obtained without serious problem such as the increasing in the minimum density and the variation in the gradation and the gradation balance if the processing time is fluctuated some degree in the usual developing process, even though the image density is slighty fluctuated.

On the other hand, the gradation is largely varied in the amplifying development, and the variation of gradation in a high density region is continued after a sufficient maximum density is formed and then the increasing in the minimum density is appeared. Consequently, the gradation balance is largely varied depending on the fluctuation of developing time. It is demanded to develop a technique for improving such the phenomenon.

It is preferred to make small the diameter of silver halide grain for reducing the amount of silver halide and the visual coarseness of printed image. However, there is a limitation to make small the silver halide grain diameter because the reducing in the grain diameter causes decreasing in the sensitivity.

JP O.P.I. No. 6-301128 suggests that the degradation of graininess caused by reducing in the coating amount of silver halide can be inhibited by using a tabular silver halide grain. This publication describes an example in which tabular silver halide grains are used in a yellow image forming silver halide emulsion layer. However, the improvement degree in the visual coarseness of a printed gray image is insufficient even though the graininess of the yellow image is improved by the use of the tabular silver halide grains. Moreover, the publication describes nothing about the problem of large variation of gradation balance depending on the fluctuation of amplifying developing time.

SUMMARY OF THE INVENTION

It has been found by the inventors that the visual coarseness of printed image and the variation in the gradation balance depending on a condition the amplifying development are reduced when the number of silver halide grains and the coating amount of silver halide in each of the color image forming layers satisfy a specific condition.

The object of the present invention is to provide an image forming method by processing a silver halide photographic light-sensitive material with an amolifying development, by which the visual coarseness of the printed image is improved the variation of gradation balance depending on the condition of amplifying development is inhibited.

The above-mentioned objects of the invention is attained by an image forming method comprising the step of (1) imagewise exposing to light a silver halide photographic material comprising a support having thereon a photographic layer including a yellow image forming silver halide emulsion layer, a magenta image forming silver halide emulsion layer and a cyan image forming silver halide emulsion layer, and (2) developing the silver halide photographic light-sensitive material with an amplifying development, wherein silver halide grains contained each of the yellow image forming silver halide emulsion layer, magenta image forming silver halide emulsion layer and the cyan image forming silver halide emulsion layer have a silver chloride content of not less than 80 mole-%, and the number of silver halide grains per a unit area in the magenta silver halide emulsion layer is larger than that in the yellow image forming silver halide emulsion layer and that in the cyan image forming silver halide emulsion layer, and the number of silver halide grains per unit area in the magenta image forming silver halide emulsion is 1.5 to 2.1 times of that in the cyan image forming silver halide emulsion layer, and the total amount of silver halide in the yellow image forming emulsion layer, the magenta image forming silver halide emulsion layer and the cyan image forming silver halide emulsion layer is within the range of from 0.01 $g/m^2$ to 0.15 $g/m^2$ in terms of silver.

DETAILED DESCRIPTION OF THE INVENTION

The silver halide photographic light-sensitive material of the invention, hereinafter referred to light-sensitive material, comprises a support having thereon a yellow image forming silver halide emulsion layer, a magenta image forming silver halide emulsion layer a cyan image forming silver halide emulsion layer, in which the number of silver halide grains per unit area is largest in the magenta image forming silver halide emulsion layer.

The number of silver halide grains per unit area in each the layer can be determined in various procedures usually used in the field of the art. For example, each of the layers are separately peeled off from a prescribed area of a light-sensitive material and the grains contained in each of the layers are photographed by an electron microscope. Then the number of silver halide grains contained in each of the layers can be directly counted on thus taken microscopic photograph. The grain number can also be counted more easily by image processing by a computer. When the silver halide emulsion is a monodisperse emulsion, the number of grains per unit area can be calculated based on the coating amount of silver halide and the average diameter of silver halide grains.

In the light-sensitive material relating to the invention, when a color image forming silver halide emulsion layer is composed of plural layers, for example a high sensitive layer and a low sensitive layer, the number of silver halide grains per unit area is the total number of silver halide grains per unit area contained in the plural silver halide emulsion layers composing the image forming silver halide emulsion layer.

In the light-sensitive material relating to the invention, the number of silver halide grains contained in a unit area of the magenta image forming silver halide emulsion layer is 1.5 to 2.1 times of the number of silver halide grains contained in the unit area of the cyan image forming silver halide emulsion layer. When the ratio is not less than 1.5, the effect on the improvement in the visual coarseness of printed image is enhanced, and when the ratio is not more than 2.1, the effect on the improvement in the variation of the gradation balance depending on the variation of the amplifying development is enhanced.

In the light-sensitive material relating to the invention, it is adequate to exist only an amount of silver halide necessary to form developed silver as a catalyst effective for amplifying development. Consequently, the coated amount of silver halide can be considerably reduced in comparison with that in a light-sensitive material to be by processed an ordinary color developing method in which the oxidation product of a color developing agent in an amount necessary for coupling with a coupler is formed by a redox reaction of silver halide with a color developing agent. The total amount of silver halide in the silver halide light-sensitive material relating to the invention is within the range of from 0.01 $g/m^2$ to 0.15 $g/m^2$ in terms of silver for improving the variation in the gradation balance. In such the case, the amount of silver halide in each of the color forming silver halide emulsion layer is preferably not more than 0.05 $g/m^2$, more preferably not more than 0.03 $g/m^2$, in terms of silver.

In the invention, the amount of light-sensitive silver halide is an amount of light-sensitive silver halide in terms of silver coated per unit area. The amount is described in $g/m^2$. The amount of silver halide can be determined by a known method, for example, an atomic light absorption analysis or a fluorescent X-ray analysis, after peeling the photographic layer of the light-sensitive material according to necessity.

For reducing the visual coarseness of the printed image and stabilizing the variation in the gradation balance caused by the fluctuation of amplifying developing time, it is preferred that the amount of silver halide in the yellow image forming silver halide emulsion layer is 1.8 to 5 times of the amount of silver halide in the magenta image forming layer. It is also preferred that the amount of silver halide in the magenta image forming silver halide emulsion layer is 0.9 to 4 times of the amount of silver halide in the cyan image forming layer.

In the embodiment of the invention, it is preferred that the following Equation (1) is satisfied in at least one of the yellow image forming silver halid emulsion layer, the magenta image forming silver halid emulsion layer and the cyan image forming silver halide emulsion layer of the silver halide photographic light-sensitive material. When the equation is satisfied, the stability of the gradation reproduction with respect to the fluctuation of the amplifying development condition is improved.

Equation (1)

$$Q/r^3 \geqq 0.27$$

In the equation, Q is the amount of silver halide contained in the image forming layer in $g/m^2$ in terms of silver, and r is the average diameter of the in terms of silver silver halide grains contained in the image forming layer in $\mu$m.

It is more preferable that Equation (2) is satisfied in at least one of the image forming silver halide emulsion layers of the silver halide photographic light-sensitive material since the improvement in the stability of the gradation reproduction with respect to the fluctuation of amplifying development condition is enhance.

Equation (2)

$$Q/r^3 \geqq 0.56$$

In Equation (2), Q and r are each synonym of those in Equation (1)

Furthermore, it is preferable that Equation (3) is satisfied in at least one of the color forming silver halide emulsion layers of the silver halide photographic light-sensitive material relating to the invention. The degradation in the visual coarseness in a highlight portion of image caused by the fluctuation of amplifying development condition is improved when Equation (3) is satisfied in the light-sensitive material.

Equation (3)

$$Q/r^3 \leqq 7.4$$

It is more preferable that Equation (4) is satisfied in at least one of the color forming silver halide emulsion layers of the silver halide photographic light-sensitive material relating to the invention since the effect of the improvement in the degradation in the visual coaseness in the highlight of image with respect to the fluctuation of amplifying development condition is enhance.

Equation (4)

$$Q/r^3 \leqq 2.7$$

In Equation (3), Q and r are each synonym of those in Equation (1).

Accordingly, it is a preferable condition in the invention that in at least one of the color forming silver halide emulsion layers, the amount of the silver halide Q and the average diameter r of the silver halide grains containined in the color forming layer satisfy the following equation (5):

Equation (5)

$$7.4 \geqq Q/r^3 \geqq 0.27$$

It is more preferable that the amount of the silver halide in terms of silver Q and the average diameter r of the silver halide grains containined in the color forming layer satisfy the following equation (6):

Equation (6)

$$2.7 \geqq Q/r^3 \geqq 0.56$$

The image forming silver halide emulsion layer in which the above-mentioned Equation (5) or (6) is satisfied is preferably the magent or cyan image forming layer, particularly preferably in the magenta image forming silver halide emulsion layer.

A pH value of the photographic layer of the light-sensitive material relating to the invention is preferably 4.5 to 6.5. The pH value of the photographic layer in the invention is a pH value of the photographic layer formed by a coating liquid for producing the light-sensitive material on a support and the pH value of the layer is not always the same as that of the coating liquid. The pH value of the photographic layer can be measured by the following method: 0.05 ml of pure water is dropped on 1 $cm^2$ of the surface of the emulson coated side of a light-sensitive material and stood for 3 minutes, the pH value of the water on the light-sensitive material after standing is measured by a flat type electrode such as GST5313F manufactured by Toa Denpa Kogyo Co, Ltd. When the pH value of layer is within the range of 4.5 to 6.5, the improving effects of the invention on the variation of the visual coarseness caused by the fluctuation in the amplifying development condition and the stability of gradation reproduction are particularly enhanced.

The pH value of the photographic layer can be controlled by adjusting the pH of the coating liquid to an appropriate value with an acid such as citric acid or sulfric acid or an alkali such as potassium hydroxide or sodium hydroxide.

In the invention, the diameter of a light-sensitive silver halide grain is defined as the diameter of a circle having an area the same as the projection area of the silver halide grain in terms of $\mu$m. The diameter of silver halide grains can be determined by various procedures usually used in the field of the art. Typical method includes those described in Loveland "Analysis method of particle diameter" A.S.T.M. Symposium on Light Microscopy, p.p. 94–122, 1955, and Mees & James, "Theory of the Photographic Process 3rd Edition" Chapter 2, Macmillan, 1966.

The silver halide emulsion relating to the invention may have any halide composition such as silver chloride, silver chlorobromide, silver chloroiodobromide, and silver chloroiodide as far as which have each a silver chlorided content of not less than 80 mole-%. The amount of silver chloride is preferably not less than 90 mole-%, further preferably 95 to 99.9 mole-%. from the viewpoint of a rapid processing ability and a stability of activity of the amplifying development.

An emulsion copmprising silver halide grains each having a portion having a high content of silver bromide is preferably used for the silver halide emulsion relating to the invention. In such the case, the emulsion may be a core/shell type emulsion in which the portion having a high silver bromide content completely forms a layer or an emulsion in which the portion having a different composition is locally existed, so-called epitaxially bonded, without formation of a complete layer. The silver halide composition may be varied continuously or discontinuously. It is particularly preferred that the portion having a high silver bromide content is localized at a corner of the silver halide grain.

It is advantageous to add a heavy metal ion to the silver halide emulsion relating to the invention. The heavy metal ion includes an ion of metal of Group VIII to X of the perodic table such as iron, iridium, platinum, palladium, nickel, rhodium, osmium, ruthenium or cobalt, an aion of meatal of Group XII of the priodic table such as cadmium, zinc or mercury, and an ion of lead, rhenium, molybdenum, tungsten, gallium or chromium. Among them, the ions of iron, iridium, platinum, ruthenium, gallium and osmium are preferred.

These metal ions may be added to the silver halide emulsion in a form of a salt or a complex.

When the foregoing metal ions each form a complex, a ligand of the complex includes an ion of cyanide, thiocyanate, isothiocyanate, cyanate, chloride, iodide, carbonyl and ammonia. Among them, the ions of cyanide, thiocyanate, isothiocyanate, chloride and bromide are preferred as the ligand thereof.

To add the heavy metal ion in the silver halide emulsion, the heavy metal compound is added at an optional step, before formation of silver halide grains, during formation of silver halide grains and during the physical ripening process after formation of the grains. For preparing the silver halide emulsion, the heavy metal compound may continuously added while the whole or a part of the grain formation process in a form of solution together with a halide salt.

When the heavy metal ion is added to the silver halide emulsion, the amount of the compound is preferably $1\times10^{-9}$ moles to $1\times10^{-2}$ moles, particularly preferably $1\times10^{-8}$ moles to $5\times10^{-5}$ moles, per mole of silver halide.

A silver halide grain having any shape is usable in the silver halide emulsion relating to the invention. An example of a preferable grain is a cubic grain having (100) face as the surface of the crystal. Besides, a grain having an octahedral, tetrahedral or dodecahedral shape can be used, which are prepared by methods described in US Pat. Nos. 4,183,756 and 4225666, JP O.P.I. No. 55-25689, Japanese Patent No. 55-42737 and The Journal of Photographic Science, 21, 39, 1973. A grain having a twinned face is also usable.

Although, an emulsion comprising silver halide grains each having an uniform shape are preferably used, it is particularly preferred to add two or more kinds of monodisperse silver halide emulsion in one layer. The diameter distribution of the silver halide grains is preferably monodisperse having a variation coefficient of not more than 0.22, more preferably not more than 0.15. It is particularly preferred that the emulsion layer contains two or more kinds of monodisperse emulsion each having a variation coefficient of not more than 0.15. The variation coefficient is a coefficient expressing the width of the diameter distribution and is defined by the following equation.

Variation coefficient=S/R

S: Standard deviation of diameter distribution

R: Average grain diameter

The diameter of the silver halide grain relating to the invention is not specifically limited. However, the diameter is preferably 0.1 to 1.2 $\mu$m, more preferably 0.2 to 1.0 $\mu$m, from the viewpoint of photographic properties such as the rapid processing ability and sensitivity.

The silver halide emulsion relating to the invention may be one prepared by any one of an acidic method, a neutral and ammoniacal method. The grain of the emulsion may be one prepared by growing by one step, or one by growing a seed grain previously prepared. The method for preparing the seed grain and that for growing the seed grain may be the same or different.

Although the procedure for reacting a water-soluble silver salt with a water-soluble halide salt may be any one of a normal mixing method, a reverse mixing method, a double-jet mixing method and a combination thereof, a silver halide grain prepared by the double-jet mixing method is preferred.

As a type of double jet mixing, a pAg controlled double-jet mixing method described in JP O.P.I. No. 54-48521 can be used.

The follwong apparatus can be used for preparing the silver halide emulsion: a apparatus described in JP O.P.I. Nos. 57-92523 and 57-92524 by which a solution of a water-soluble silver salt and a solution of a water-soluble halide salt are supplied from devices arranged in the mother liquid of the reaction, an apparatus described in German Patent OSL No. 2921164 by which a solution of water-soluble silver salt and a solution of water-soluble halide are each supplied while the concentration thereof is continuously varied, and an apparatus described in JP No. 56-501776 by which the reaction mother liquid is taken out from the reacting vessel and concentrated by an ultrafiltration method so that the grains are grown while maintaining the distance between the individual grain at a constant value.

Furthermore, a silver halide solvent such as a thioether may be used when it is necessary. A compound having a mercapto group, a nitrogen-containing heterocyclic compound or a sensitizing dye may be added during formation of silver halide grain or after the completion of the grain formation.

As the silver halide grain relating to the invention, a grain so called tabular silver halide is preferred. As the tabular grain having a high silver chloride content, one having a (111) major face and one having a (100) major face are usable, and the grain having a (100) major face is preferred from the viewpoint of stability of the silver halide grain.

A sensitization using a gold compound, a sensitization using a chalcogen sensitizer and a combination thereof can be applied to the silver halide emulsion to be used in the invention.

The chalcogen sensitizer usable to the silver halide emulsion relating to the invention includes a sulfur sensitizer, selenium sensitizer and tellurium sensitizer, and the sulfur sensitizer is preferable.

A known antifoggant and stabilizer can be used in the silver halide emulsion relating to the invention for the purpose of preventing fogging during the preparation processes, inhibiting variation in the photographic properties during storage and preventing fogging in the developing process. Example of preferable compound usable for such the purpose includes ones represented by Formula (II) described on page 7, lower column, of JP O.P.I. No. 2-146036. These compounds are added to the emulsion at the preparation processes thereof such as a grain formation process, a chemical sensitization process, after the chemical sensitization or a coating liquid preparation process.

Dyes having absorption at various wavelength region can be used in the light-sensitive material relating to the invention for the purpose of antihalation or antiiradiation. Although any of know dye can be used for such the purpose, Dyes AI-1 through AI-11 described on page 308 of JP O.P.I. No. 3-251840, and dyes described in JP O.P.I. No. 6-3770 are preferably used as visible ray absorbing dyes. As an infrared absorbing dye, compounds represented by Formula (I), (II) or (III) described on page 2, lower-left column, are preferred, each of which has a preferable spectral absorption property and no influence on the photographic characteristics of the silver halide emulsion, and causes no stain by color remaining.

For the purpose of improving the sharpness, it is preferable that the amount of the dye is decided so that the reflective density at 680 nm of the light-sensitive material before processing is not less than 0.7, more preferably not less than 0.8.

It is preferable to add a fluorescent whitening agent in the light-sensitive material relating to the invention for improving a whiteness of background the image. Compounds represented by Formula II described in JP O.P.I. No. 2-232652 are preferably used.

The light-sensitive material relating to the invention has layers each containing a silver halide emulsion spectrally sensitized at a specified wave-length region within the spectral range of 400 to 900 nm and one of a yellow dye forming substance, a magenta dye forming substance and a cyan dye forming substance. Each of the layer contains one or more sensitizing dyes.

Any compound know as spectral sensitizing dye can be used in the silver halide emulsion relating to the invention. As a blue-sensitizing dye, Sensitizing Dyes BS-1 through BS-8 described on page 28 of JP O.P.I. No. 3-251840 can preferably used solely or in combination. Sensitizing Dyes GS-1 through GS-5 described on page 28 of the same publication each can preferably used as a green-sensitizing dye. Sensitizing Dyes RS-1 through RS-8 described on page 29 of the same publication each can preferably used as a red-sensitizing dye. When the imagewise exposure is carried out with infrared ray using a semiconductor laser, an infrared-sensitizing dye is used. As the infrared-sensitizing dye, IRS 1 through IRS-11 described on pages 6–8 of JP O.P.I. No. 4-285950 are preferably used. It is preferable that these infrared-, red-, green-and blue- sensitive sensitizing dyes are each used with a supersensitizer such as Compounds SS-1 through SS-9 described on pages 8–9 of JP O.P.I. No. 4-285950 or a compound such as Compounds S-1 through S-17 described on pages 15-17 of JP. O.P.I. No. 5-66515 in combination.

The sensitizing dye is added to the emulsion at an optional step during the silver halide grain formation to the completion of chemical sensitization.

The sensitizing dye can be added in a form of solution in a water-miscible organic solvent such as methanol, ethanol, fluorized alcohol, acetone or dimethylformamide, or water, or in a form of solid particle dispersion.

A dye forming substance usable in the invention includes, for example, a coupler capable of forming an image dye upon a couling reaction with the oxdation product of a color developing agent, and a compound capable of releasing an image dye upon a redox reaction with the oxidation product of a color developing agent. Among them, the coupler capable of forming an image dye upon a couling reaction with the oxdation product of a color developing agent is freferably used.

When a coupler is used as the dye forming substance, any compound capable of forming a coupling product having a absorption maximum wavelength within the range of not less than 340 nm, upon coupling reaction with the oxidation product of a color developing agent. Typical examples of the coupler include a yellow dye forming coupler having the maximum absorption wavelength within the range of 350 nm to 500 nm, a magenta dye forming coupler having the maximum absorption wavelength within the range of 500 nm to 600 nm, and a cyan dye forming coupler having the maximum absorption wavelength within the range of 600 nm to 750 nm.

Cyan couplers preferably usable in the light-sensitive material relating to the invention include cyan couplers represented by Formula (C-I) or (C-II) described on page 5, lower left column, of JP O.P.I. No. 4-114154, cyan couplers represented by Formula (Ia), (Ib) or (Ic) described on page 4, lower left column, of JP O.P.I. No. 2-236056, and cyan couplers represented by Formula (IIα) to Formula (VIIIα)

described on page 6, lower right column, to page 7, upper left column, of JP O.P.I. No. 1-224761 and those represented by Formula (IIβ) to Formula (VIIIβ) on page 7, lower right column, to page 8, upper left column, of the same publication. The cyan couplers represented by Formula (IIλ) to Formula (VIIIλ) or Formula (II$\mu$) to Formula (VIII$\mu$) are preferred since dyes formed from them each has a sharp absorption and is excellent in the color reproduction.

Magenta couplers preferably usable in the light-sensitive material relating to the invention include couplers represented by Formula (M-I) or (M-II) described on page 4, upper right column, of JP O.P.I. 4-114154. Among the magenta couplers, those represented by Formula (M-I) are preferable and those each having a tertiary alkyl group as the group represented by RM in Formula (M-I) described on page 4, upper right column, are particular preferable since they are excellent in the light-fastness thereof.

Yellow couplers preferably usable in the light-sensitive material relating to the invention include couplers represented by Formula [Y-I] described on page 3, upper right column, of JP O.P.I. No. 4-114154. Among them, couplers having each an alkoxy group as the group represented by RY1 in Formula [Y-I], or couplers represented by Formula [I] described in JP O.P.I. No. 6-67388 are preferred since they can reproduce preferable tone of yellow color. Most preferred compounds are those represented by Formula [Y-1] described on pages 1 and 11 to 17 of JP O.P.I. No. 4-81847.

Concrete examples of couplers preferably usable in the light-sensitive material relating to the invention are shown below.

C-1

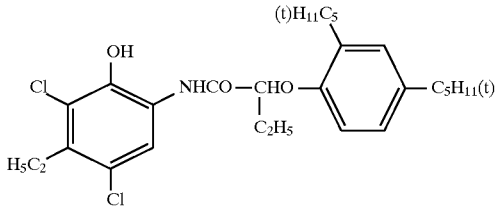

C-2

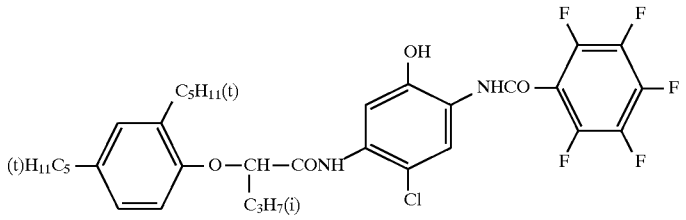

C-3

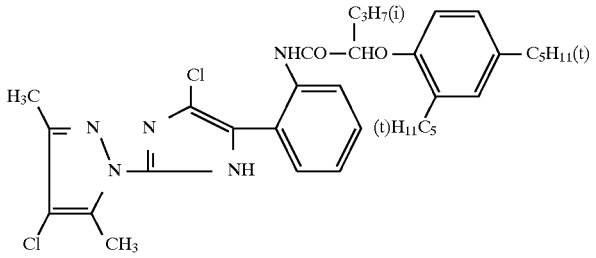

C-4

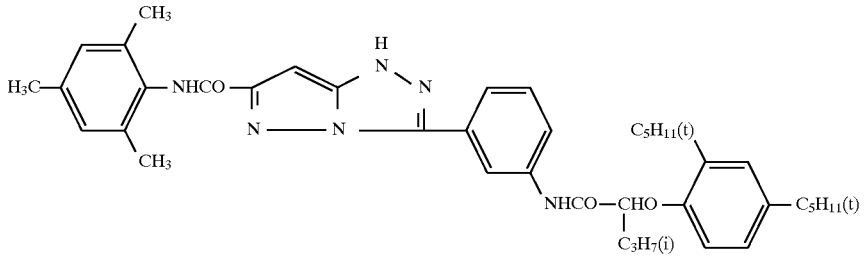

C-5

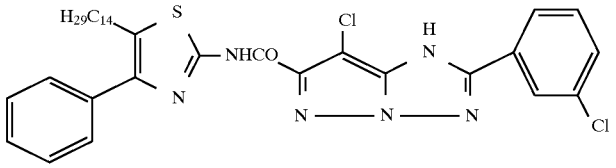

-continued
C-6
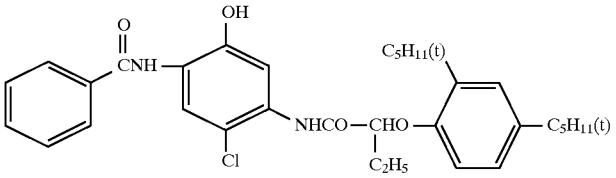
Y-1
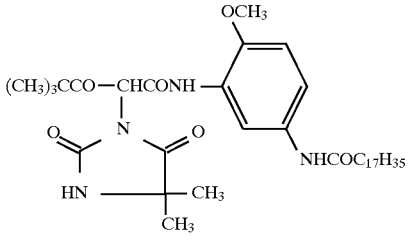
Y-2
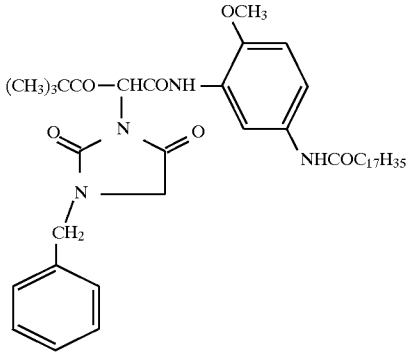
Y-3
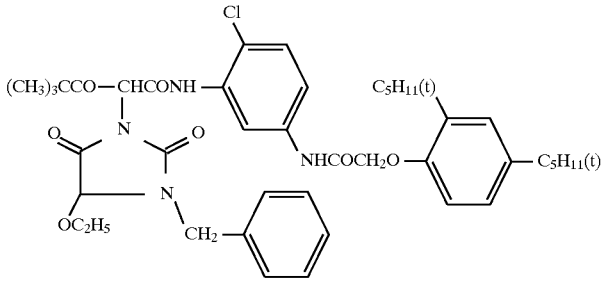
M-1
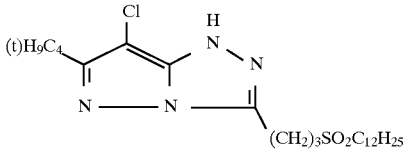
M-2
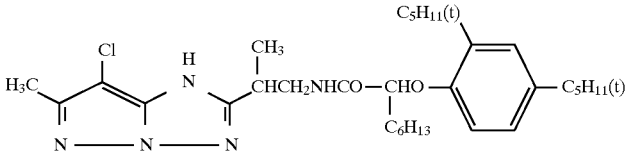

-continued

M-3

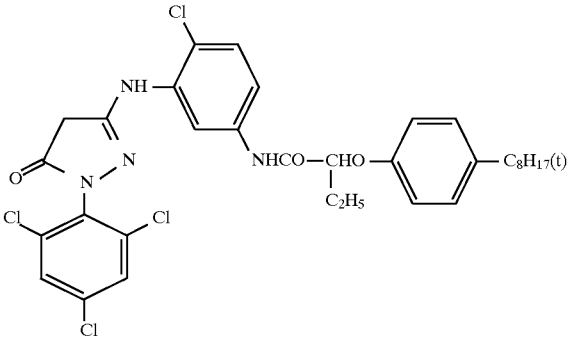

When an oil-in-water dispersion method is applied for adding the color forming substance or another organic compound to the light-sensitive material, the color forming substance or another organic compound is usually dissolved in an water- insoluble high-boiling organic solvent having a boiling point of 150° C. or more, in which a low-boiling and/or a water-soluble organic solvent is used in combination according to necessity, and dispersed in a hydrophilic binder such as a gelatin solution using a surfactant. The high-boiling organic solvent usable for dissolving and dispersing the dye forming substance is preferably one having a dielectric constant of 3.5 to 7.0. Two or more kinds of organic solvent can be used in combination.

Furthermore, a method can be applied, by which a polymer insoluble in water and soluble in an organic solvent is dissolved in a low-boiling solvent and/or water-soluble solvent, in place of or together with the high-boiling solvent, and dispersed in a hydrophilic binder such as a gelatin solution by means of various dispersing methods using a surfactant.

A preferable surfactant usable for dispersing a photographic additive or controlling the surface tension of a coating liquid, includes compounds each having a hydrophobic group having 8 to 30 carbon atoms and a sulfonic acid group or its salt in the molecular thereof. A surfactant having an alkyl group substituted by a fluorine atom are also preferably usable. The dispersions are usually added to a coating liquid containing a silver halide emulsion. In such the case, it is preferred that the time from the addition of the dispersion to the coating liquid to coating the liquid is shortened, and the time is preferably not more than 10 hours, more preferably not more than 3 hours, further preferably not more than 20 minutes.

It is preferable to use a discoloration preventing agent with the color forming substance to prevent discoloration of dye image caused by light, heat or moisture. Particularly, phenyl ether compounds represented by Formulas I or II described on page 3 of JP O.P.I. No. 2-66541, phenol compounds represented by Formula IIIB described in JP O.P.I. No. 3-174150, amine compounds represented by Formula A described in JP O.P.I. No. 64-90445, and metal complex compounds represented by Formula XII, XIII, XIV or XV are preferably used for the magenta dye. Compounds represented by Formula I' described in JP O.P.I. No. 1-196049 and those represented by Formula II described in JP O.P.I. No. 5-11417 are particularly preferred for the yellow or cyan dye.

Compound (d-11) described on page 9, lower left column, of JP O.P.I. No. 4-114154 and Compound (A'-1) described on page 1C, lower left column, of the same publication can be use for the purpose of shifting the absorption wavelength of the formed dye. Further, a fluorescent dye releasing compound described in U.S. Pat. No. 4774187 can also be used.

In the light-sensitive material relating to the invention, it is preferable that a compound capable of reacting with the oxidation product of a color developing agent is added to a layer arranged between light-sensitive layers for preventing color contamination, or to a silver halide emulsion layer to prevent fogging. Hydroquinone derivatives are preferably usable for such the purpose, among them dialkylhydroquinones such as 2,5-di-t-octylhyderoquinone are more preferable.

It is preferred that a UV absorbent is added to the light-sensitive material for preventing static fog and improving light-fastness of the dye image. Benzotriazoles are preferred as the UV absorbent. Particularly preferable compounds include those represented by Formula III-3 described in JP O.P.I. No. 1-250944, those represented by Formula III described in JP O.P.I. No. 64-66646, Compounds UV-1L to UV-27L described in JP O.P.I. No. 63-187240 and those represented by Formula (I) or (II) described in JP O.P.I. No. 5-165144.

Although gelatin is advantageously used in the light-sensitive material, a hydrophilic colloid such as a gelatin derivative, a graft-polymer of gelatin and another high molecular substance, a protein other than gelatin, a sugar derivative, a cellulose derivative or a homo- or co-polymer of synthetic hydrophilic high molecular substance, can also be usable.

As the hardener for these binders, a vinylsulfon type hardener and a chlorotriazine type hardener are preferably used singly or in combination. Compounds described in JP O.P.I. Nos. 61-249054 and 61-245153 are preferably used. An antiseptic and an antimold agent such as ones described in JP O.P.I. No. 3-157646 are preferably added to the hydrophilic colloid layer to prevent breeding a mold or bacillus which gives a bad influence on the photographic properties or the storage ability of the image. Furthermore, it is preferable to add a lubricant and a matting agent described in JP O.P.I. Nos. 6-118543 and 2-73250 to the protective layer for improving the surface property of the light-sensitive material before and after the processing.

As the support of the light-sensitive material relating to the invention, one composed of any material can be used, and paper laminated with polyethylene terephthalate, paper composed of natural pulp or synthetic pulp, a sheet of vinyl chloride, polypropylene and polyethylene terephthalate which may contain a white pigment, and barita paper are usable. Among them, a support composed of paper having a water-proof resin layer on both sides thereof is preferred. Polyethylene, polyethylene terephthalate or their copolymer is preferred as the water-proof resin.

An inorganic and/or organic white pigment, preferably an inorganic white pigment, is usable in the support.

A center-line average hights roughness (SRa) of the support surface is preferably not more than 0.15 $\mu$m, more preferably 0.12 μm, since a high glossiness can be obtained. It is preferred to add a slight amount of blue or red-tinting agent such as ultramarine or an oil-soluble dye to the white pigment-containing waterproof resin layer or in a coated hydrophilic colloid layer for improving the whiteness thereof by adjusting the balance in the spectral reflective density.

The hydrophilic colloid layer of the light-sensitive material may be coated on the support directly or through one or more subbing layers for raising the properties of the support surface such as the adhesive ability, antistatic ability, anti-abrasion, hardness, anti-halation, and frictional property. The surface of the support may be subjected to a treatment by corona discharge, UV irradiation or flame before coating the layer, according to necessity.

In a coating liquid to form a layer of the light-sensitive material, a thickener may be used for improving the coating ability of the coating liquid. An extrusion coating and a curtain coating are particularly suitable as the coating method by which two or more layers can be coated simultaneously.

Methods to form a photographic image on the light-sensitive material relating to the invention include a method by which an image recorded on a negative is optically focused on the light-sensitive material and printed, a method by which the negative image is once converted to digital information and displayed on a CRT, and the image displayed on the CRT is focused on the light-sensitive material and printed, and a method by which the printing is carried out by scanning by a laser beam, the intensity or tradiating time of which is modulated with the digital information.

The present invention is preferably applied to a color paper, a color reversal paper, a light-sensitive material to form a positive image, a light-sensitive material for a display and a light-sensitive material for a color-proof. It is particularly preferred to apply the invention to a light-sensitive material having a reflective support.

The effects of the invention is realized when the light-sensitive material relating to the invention is developed by an amplifying development. The amplifying development is described below.

In the invention, the amplifying development is defined as a development method which is carried out by forming developed silver by developing an latent image on an imagewise light-sensitive material with a color or black-and-exposed white developing agent, and forming or releasing an image dye by a chemical reaction caused by the developed silver as a catalyst. For example, a method is cited by which a image dye is formed by a coupling reaction of a coupler and the oxidation product of a developing agent generated by a redox reaction of an oxidizing agent and a developing agent in the presence of the developed silver as a catalyst.

Hydrogen peroxide, a compound capable of generating hydrogen peroxide such as a hydrogen peroxide adduct, a peroxo-compound such as peroxoborate or peroxocarbonate, a cobalt(III) complex such as a cobalt-hexammine complex, a halogenite such as a chlorite, and a periodate are usable as the oxidizing agent. Among them, a method using hydrogen peroxide is advantageous since which has a high amplifying effect and a low environmental loading.

In the amplifying development relating to the invention, a combination of an aromatic primary amine developing agent and hydrogen peroxide is preferably used. The aromatic primary amine developing agent includes N,N-diethyl-p-phenylenediamine, 2-amino-5-diethylaminotoluene, 2-amino-5 -(N-ethyl-N-laurylamino) toluene, 4-{N-ethyl-N-(β-hydroxyethyl)amino}aniline, 2-methyl-4-{N-ethyl-N-(μ-hydroxyethyl)amino}aniline, 4-amino-3-methyl-N-ethyl-N-{μ(methanesulfonamido) ethyl}aniline, N-(2-amino-5-diethylaminophenylethyl) methanesulfonamide, N,N-dimethyl-p-phenylenediamine, 4-amino-3-methyl-N-ethyl-N- methoxyethylaniline, 4-amino-3-methyl-N-ethyl-N-(μ-ethoxyethyl)aniline and 4-amino-3-methyl-N-ethyl-N-(γ-hydroxypropyl)aniline.

A sulfonylhydrazide or carbonylhydrazide type developing agnet described in, for example, European Patent Nos. 565,165, 572,054, and 593,110, JP O.P.I. Nos. 8-202002, 8-227131 and 8- 234390, are also preferably usable other than the aromatic primary amine developing agent.

It is preferred to use the foregoing color developing agent and a black-and-white developing agent in combination in the amplifying developing solution because the processing time of the amplifying development can be shortened in addition to the effect of the invention. Besides when the light-sensitive material comprises plural color forming layers the influence of the development of another layer on a layer is lowered and stability of the gradation reproduction is enhanced by such the technique.

The black-and-white developing agent usable in the invention includes dihydroxybenzenes, 3-pyrazolidones, pyrogallols, glysines, hydroxylamines, hydrazines, aminophenols, reductones, 3-aminopyrazolines, complexes of transition metals such as complexes of Ti, Cr, Mn, Fe, Co, Ni and Cu, which are each required to be a form having a reducing ability, for example, in a form of $Ti^{3+}$, $V^{2+}$, $Cr^{2+}$, and $Fe^{2+}$, for use a developing solution. The ligand of the complexs includes a polyaminopolycarbonic acid or its salt such as ethylenediaminetetraacetic acid (EDTA), and ethylentri-aminepentaacetic acid (DTPA), and a phosphate or its salt such as hexametapolyphosphic acid and tetrapolyphosphic acid. Among them, hydroxybenzenes, 3-pyrazolidones, hydroxylamines and reductones are preferred. The using amount of the black-and-white developing agent is preferably 0.1 to 3.0, more preferably 0.25 to 2.0, in the mole ratio to the color developing agent.

The developing agent and the oxidizing agent for amplifying development can be supplied to the light-sensitive material as a processing solution in which the developing agent and the oxidizing agent are coexisted, or as separate solutions each contains separately the developing agent and the oxidizing agent, respectively.

As the amplifying development method, for example, a method described in JP O.P.I. Nos. 52-13335, 55-127555 and 6- 77851 in which a developer containing the developing agent and the oxidizing agent, i.e., a developing/amplifying solution, is used and the formation of silver to be the catalyst and the amplifying developing are continuously carried out in the same processing bath, a method described in JP O.P.I. Nos. 5-216192 and 5-346647 in which a developing bath containing the developing agent and an amplifying bath containing the oxidizing agent are separated and the developed silver is formed in the developing bath and the developing agent is taken into the amplifying bath so as to perform the amplifying development, or a method described in JP O.P.I. Nos. 61-88259 and 7-077788 in which the developing silver is formed by processing with a developing bath containing the developing agent and the processed by a bath containing the developing agent and the oxidizing agent to perform the amplifying development, can be applied. Furthermore, a method described in JP O.P.I. No. 61-80150 by which a developing solution or an amplifying solution is sprayed to the silver halide light-sensitive material can be applied as a method using no processing bath.

When the developing bath and the amplifying bath are separated, the amount of the developing agent in the developing solution is preferably 0.2 to 50 g/l, particularly preferably 1 to 25 g/l. The amount of hydrogen peroxide in the amplifying solution is 0.1 to 100 ml/l of 30%-solution of hydrogen peroxide.

When the processing is carried out by one bath containing the developing agent and the oxidizing agent, the amount of the developing agent in the developing/amplifying solution is preferably 0.5 to 15 g/l, more preferably 1 to 7 g/l, and the amount of a 30%-solution of hydrogen peroxide is preferably 0.1 to 30 ml/l, more preferably 1 to 5 ml/l.

In the invention, although the developing solution, amplifying solution and developing/amplifying solution can be used at any pH value, the pH value is preferably 9.0 to 12.5, more preferably 10.5 to 12.0, from the viewpoint of rapid processing and the stability of the processing solution.

In the invention, the pH at the time of the amplifying development means the pH of a developing/amplifying solution when the processing is carried out by the developing/amplifying solution in which the developing agent and the oxidizing agent for amplifying development are coexisted, and means the pH of an amplifying solution in the amplifying bath when the treatment is separately carried out by a developing bath and an amplifying bath. When the developing solution and the amplifying solution are separately supplied to a light-sensitive material, the pH at the time of amplifying development is defined by the pH of a mixture of these solutions in a ratio of the amounts to be supplied to the light-sensitive material. In the invention, the pH at the amplifying development is preferably 9.0 to 12.5, more preferably 10.5 to 12.0, from the viewpoint of rapid processing.

The temperature of the amplifying development relating to the invention is preferably not less than 20° C. and not more than 60° C. Although a higher temperature is preferred for rapid processing, a temperature not exessively high is preferable for stability of the processing solution. Therefore the processing at a temperature of 25° C. to 55° C. is preferred.

Although the time of amplifying development is changed depending on the processing temperature and the activity of the processing solution, the processing time is preferably not more than 180 seconds, more preferably not more than 90 seconds.

In addition to the color developing agent and the oxidizing agent, known components usually used in a developing solution can be added to the developing solution, the amplifying solution or the developing/amplifying solution. An alkaline agent having a buffering effect, a developing inhibitor such as a chloride ion or benzotriazoles, a preservant and a chelating agent are usually used.

Known buffering agents can be used as the pH buffer. Among them, a buffer composed of a combination of a carbonate and/or a phosphate is preferable since it can be used with a low cost.

The light-sensitive material relating to the invention may be subjected to a bleaching treatment and a fixing treatment after the amplifyinge color development, according to necessity. The bleaching treatment may be carried out with the fixing treatment at the same time. A washing treatment is usually applied after the fixing treatment. A stabilizing treatment may be applied in place of the washing treatment. A roller transport type processor in which the light-sensitive material is put between transported rollers and transported by the rollers arranged in the processing bath, and an endless belt type processor in which the light-sensitive material is attached on a belt and transported, are usable as the processor for processing the light-sensitive material relating to the invention. A method using a processor having a slit-shaped processing bath in which a processing solution is supplied to the processing bath so as to transport the light-sensitive material can be used. A spray method by which the processing solution is sprayed, a web method by which a web immersed with a processing solution is contacted to the light-sensitive material, and a method using a viscous processing solution can also be used.

EXAMPLES

The invention is described below according to examples.

Example 1

(Preparation of blue-sensitive silver halide emulsion Em-B1) To 1 liter of an aqueous 2%-solution of gelatin kept at 40° C., the following Solution A1 and Solution B1 were simultaneously added while maintaining pAg at 7.3 and pH at 3.0, and then Solution C1 and Solution D1 were simultaneously added while maintaining pAg at 8.0 and pH at 5.5. The pAg was controlled by the method described in JP O.P.I. No. 59-45437 and the pH was controlled by using a solution of sulfric acid or sodium hydroxide.

Solution A1
- Sodium chloride 3.42 g
- Potassium bromide 0.03 g
- Water to make 200 ml Solution B1
- Silver nitrate 10 g
- Water to make 200 ml Solution C1
- Sodium chloride 102.7 g
- Potassium hexachloroiridate(IV) $4\times10^{-8}$ moles
- Potassium ferri(II)hexacyanate $2\times10^{-5}$ moles
- Potassium bromide 1.0 g
- Water to make 600 ml Solution D1
- Silver nitrate 300 g
- Water to make 600 ml After the completion of the addition, the emulsion was desalted-by using a 5%-solution of Demol N, manufactured by Kao-Atras Co., and a 20%-solution of magnesium sulfate, and mixed with an aqueous gelatin solution. Thus a monodisperse cubic emulsion EMP-1A was obtained which has an average grain diameter of 0.71 μm, a variation coefficient of grain diameter distribution of 0.07 and a silver chloride content of 99.5 mole-%. Next, a monodisperse cubic emulsion EMP-1B was prepared in the same manner as in EMP-1A except that the time for addition of Solution A1 and Solution B1, and that of Solution C1 and Solution D1 were changed. EMP-1B has an average grain diameter of 0.64 μm, a variation coefficient of grain diameter distribution of 0.07 and a silver chloride content of 99.5 mole-%.

The above Emulsions EMP-1A and EMP-1B were each chemically sensitized optimally at 60° C. using the following compounds. Then sensitized EMP-1A and EMP-1B were mixed in a ratio of 1:1 to prepare a blue-sensitive silver halide emulsion Em—B1.

- Sodium thiosulfate 0.8 mg/mole of AgX
- Chloroauric acid 0.5 mg/mole of AgX
- Stabilizer STB-1 $3\times10^{-4}$ moles/mole of AgX
- Stabilizer STB-2 $3\times10^{-4}$ moles/mole of AgX
- Stabilizer STB-3 $3\times10^{-4}$ moles/mole of AgX
- Sensitizing dye BS-1 $4\times10^{-4}$ moles/mole of AgX
- Sensitizing dye BS-2 $1\times10^{-4}$ moles/mole of AgX (Preparation of green-sensitive silver halide emulsion)

A monodisperse cubic emulsion EMP-11A having an average grain diameter of 0.40 μm and a silver chloride content of 99.5 mole-% and a monodisperse cubic emulsion EMP-11B having an average grain diameter of 0.45 μm and a silver chloride content of 99.5 mole-% were each prepared in the same manner as in EMP-1A except that the time for addition of Solution A1 and Solution B1, and that of Solution C1 and Solution D1 were changed.

The above Emulsion EMP-11A and EMP-11B were each chemically sensitized optimally at 55° C. using the following compounds. Then sensitized EMP-11A and EMP-11B were mixed in a ratio of 1:1 to prepare a green-sensitive silver halide emulsion Em-G1.

Sodium thiosulfate 1.5 mg/mole of AgX

Chloroauric acid 1.0 mg/mole of AgX

Stabilizer STB-1 $3\times10^{-4}$ moles/mole of AgX

Stabilizer STB-2 $3\times10^{-4}$ moles/mole of AgX

Stabilizer STB-3 $3\times10^{-4}$ moles/mole of AgX

Sensitizing dye GS-1 $4\times10^{-4}$ moles/mole of AgX (Preparation of red-sensitive silver halide emulsion) A monodisperse cubic emulsion EMP-21A having an average grain diameter of 0.43 μm and a silver chloride content of 99.5 mole-%, and a monodisperse cubic emulsion EMP-21B having an average grain diameter of 0.40 μm and a silver chloride content of 99.5 mole-% were each prepared in the same manner as in EMP-1A except that the time for addition of Solution Al and Solution B1, and that of Solution C1 and Solution D1 were changed.

The above Emulsion EMP-21A and EMP-21B were each chemically sensitized optimally at 60° C. using the following compounds. Then sensitized EMP-21A and EMP-21B were mixed in a ratio of 1:1 to prepare a red-sensitive silver halide emulsion Em—R1.

Sodium thiosulfate 1.8 mg/mole of AgX

Chloroauric acid 2.0 mg/mole of AgX

Stabilizer STB-1 $3\times10^{-4}$ moles/mole of AgX

Stabilizer STB-2 $3\times10^{-4}$ moles/mole of AgX

Stabilizer STB-3 $3\times10^{-4}$ moles/mole of AgX

Sensitizing dye RS-1 $1\times10^{-4}$ moles/mole of AgX

Sensitizing dye RS-2 $1\times10^{-4}$ moles/mole of AgX

STB-1:1-(3-acetoamidophenyl)-5-mercaptotetrazole

STB-2:1-phenyl-5-mercaptotetrazole

STB-3:1-(4-ethoxyphenyl)-5-mercaptotetrazole

BS-1

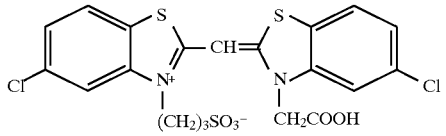

BS-2

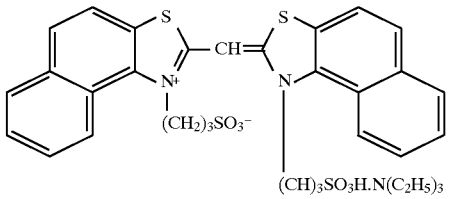

GS-1

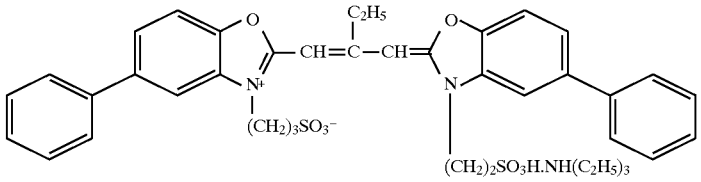

GR-1

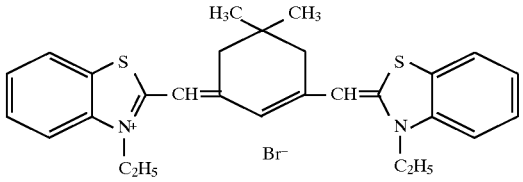

GR-2

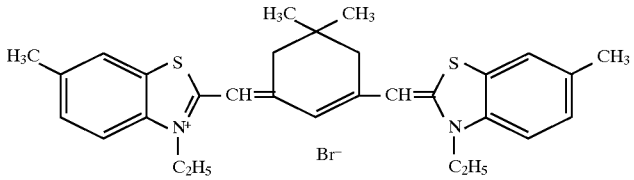

(Preparation of samples of silver halide photographic light-sensitive material)

A reflective paper support was prepared by laminating a high-density polyethylene on the both sides of raw paper of 180 g/m$^2$. The surface of the paper on which the silver halide emulsion layers to be coated was laminated with molten polyethylene containing surface treated anatase type titanium dioxide in an amount of 15% by weight in a dispersed state. The support was subjected to a corona discharge treatment, then provided with a gelatin subbing layer, and layers having the following compositions were coated. Thus Samples 101 to 112 of silver halide photographic light-sensitive material were prepared. Coating amounts of the components of each of layers were given below.

| | Amount ($g/m^2$) |
|---|---|
| 7th layer (Protective layer) | |
| Gelatin | 1.00 |
| DIDP | 0.002 |
| DBP | 0.002 |
| Silicon dioxide | 0.003 |
| 6th layer (UV absorbing layer) | |
| Gelatin | 0.40 |
| AI-1 | 0.01 |
| UV absorbent UV-1 | 0.12 |
| UV absorbent UV-2 | 0.04 |
| UV absorbent UV-3 | 0.16 |
| Stain preventing agent HQ-5 | 0.04 |
| PVP | 0.03 |
| 5th layer (Red-sensitive layer) | |
| Gelatin | 1.30 |
| Red-sensitive emulsion Em-R1 | See Table 1 |
| Cyan coupler C-1 | 0.25 |
| Cyan coupler C-2 | 0.08 |
| Dye image stabilizing agent ST-1 | 0.10 |
| Stain preventing agent HQ-1 | 0.004 |
| DBP | 0.10 |
| DOP | 0.20 |
| 4th layer (UV absorbing layer) | |
| Gelatin | 0.94 |
| UV absorbent UV-1 | 0.28 |
| UV absorbent UV-2 | 0.09 |
| UV absorbent UV-3 | 0.38 |
| AI-1 | 0.02 |
| Stain preventing agent HQ-5 | 0.10 |
| 3rd layer (Green-sensitive layer) | |
| Gelatin | 1.30 |
| AI-2 | 0.01 |
| Green-sensitive emulsion Em-G1 | See Table 1 |
| Magenta coupler M-1 | 0.20 |
| Dye image stabilizing agent ST-3 | 0.20 |
| Dye image stabilizing agent ST-4 | 0.17 |
| DIDP | 0.13 |
| DBP | 0.13 |
| 2nd layer (Interlayer) | |
| Gelatin | 1.20 |
| AI-3 | 0.01 |
| Stain preventing agent HQ-2 | 0.03 |

-continued

| | Amount ($g/m^2$) |
|---|---|
| Stain preventing agent HQ-3 | 0.03 |
| Stain preventing agent HQ-4 | 0.05 |
| Stain preventing agent HQ-5 | 0.23 |
| DIDP | 0.04 |
| DBP | 0.02 |
| Whitening agent W-1 | 0.10 |
| 1st layer (Blue-sensitive layer) | |
| Gelatin | 1.20 |
| Blue-sensitive emulsion Em-B1 | See Table 1 |
| Yellow coupler Y-1 | 0.70 |
| Dye image stabilizing agent ST-1 | 0.10 |
| Dye image stabilizing agent ST-2 | 0.10 |
| Dye image stabilizing agent ST-5 | 0.10 |
| Stain Preventing agent HQ-1 | 0.01 |
| Image stabilizing agent A | 0.15 |
| DBP | 0.10 |
| DNP | 0.05 |

Support Polyethylene laminated paper

Compounds H-1 and H-2 were added as hardeners. Surfactant SU-1 was used as a coupler dispersing aid, and surfactants SU-2 and SU-3 were added as coating aids for controlling the surface tension. Compound F-1 was added to each of the layers so that the total amount was 0.04 $g/m^2$.

SU-1: Sodium tri-i-propylnaphthalenesulfonate

SU-2: Sodium salt of di(2-ethylhexyl) sulfosuccinate

SU-3: Sodium salt of di(2,2,3,3,4,4,5,5-octafluoropentyl) sulfosuccinate

H-1: Tetrakis(vinylsulfomethyl)methane

H-2: Sodium salt of 2,4-dichloro-6-hydrxy-s-triazine

DBP: Dibutyl phthalate

DIDP: Diiso-decyl phthalate

DOP: Dioctyl phthalate

DNP: Dinonyl phthalate

PVP: Polyvinylpyrrolidone

HQ-1: 2,5-di-t-octylhydroquinone

HQ-2: 2,5-di-sec-dodeclyhydroquinone

HQ-3: 2,5-di-sec-tetradecylhydroquinone

HQ-4: 2,5-di-sec-dodecyl-5-sec-tetradecylhydroquinone

HQ-5: 2,5-di(1,1-dimethyl-4-hexyloxycarbonyl) butylhydroquinone

Image stabilizing agent A: p-t-octylphenol

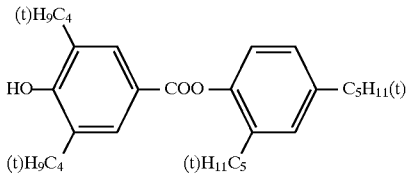

ST-1

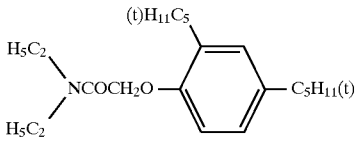

ST-2

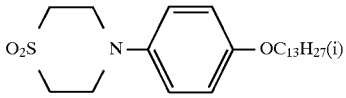

ST-3

-continued
ST-4
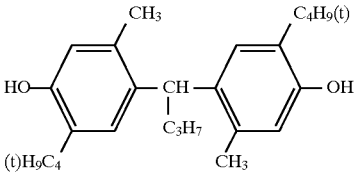
ST-5
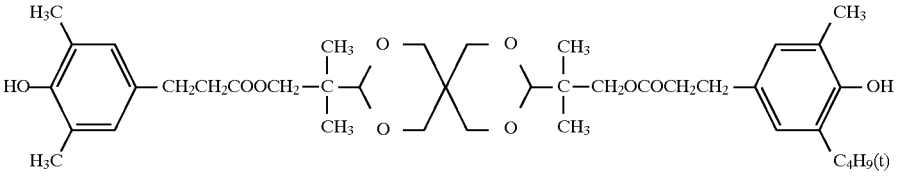
AI-1
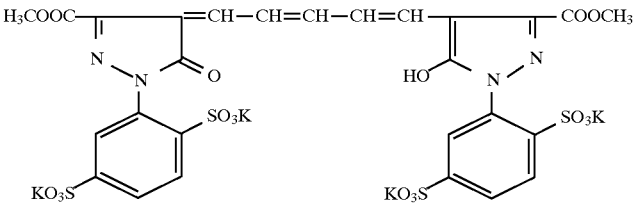
AI-2
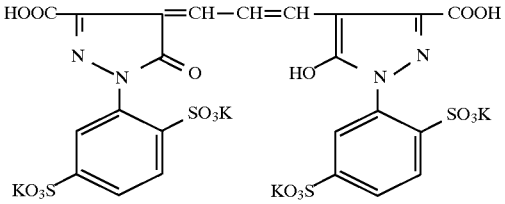
AI-3
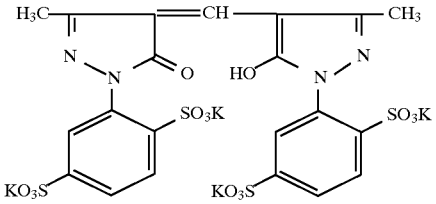
F-1
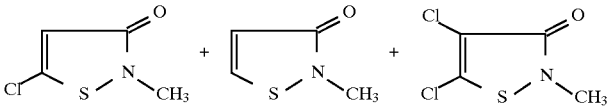
Mixture in a mole ratio of 50:46:4
UV-1
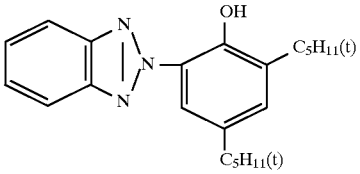
UV-2
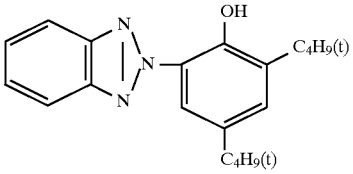

-continued

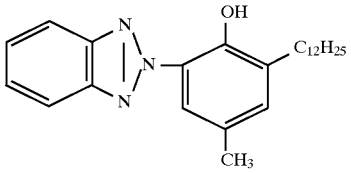

UV-3

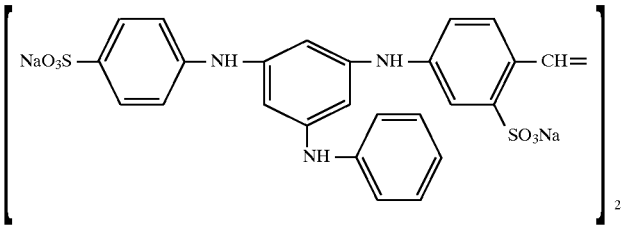

W-1

TABLE 1

| Sample No. | Amount and ratio of silver halide: Total (mg/m²) | QY/QM | QM/QC | Ratio of number of silver halide grains: NM/NC | NM/NY | Remarks |
|---|---|---|---|---|---|---|
| 101 | 58.1 | 2.31 | 0.87 | 0.80 | 1.73 | Comp. |
| 102 | 58.1 | 2.69 | 1.30 | 1.20 | 1.48 | Comp. |
| 103 | 58.1 | 1.82 | 1.70 | 1.57 | 2.19 | Inv. |
| 104 | 75.0 | 1.86 | 1.83 | 1.70 | 2.14 | Inv. |
| 105 | 75.0 | 1.52 | 2.08 | 1.93 | 2.63 | Inv. |
| 106 | 75.0 | 1.60 | 2.50 | 2.31 | 2.50 | Comp. |
| 107 | 77.1 | 3.47 | 1.50 | 1.39 | 1.15 | Comp. |
| 108 | 85.0 | 1.50 | 3.00 | 2.78 | 2.66 | Comp. |
| 109 | 50.9 | 3.18 | 2.20 | 2.04 | 1.26 | Inv. |
| 110 | 105.1 | 1.58 | 1.65 | 1.58 | 2.54 | Inv. |
| 111 | 125.1 | 1.66 | 1.58 | 1.42 | 2.41 | Comp. |
| 112 | 73.0 | 3.80 | 0.40 | 0.37 | 1.05 | Comp. |

In table 1, the amount of silver halide is described in silver.

QY/QM is a ratio of the amount of silver halide in the yellow image forming layer to that in the magenta image forming layer.

QY/QM is a ratio of the amount of silver halide in the age forming layer to that in the cyan image forming NM/NC is a ratio of the number of silver halide grains in the magenta image forming layer to that in the cyan image forming layer.

NM/NY is a ratio of the number of silver halide grains in the magenta image forming layer to that in the yellow image forming layer.

(Evaluation of the light-sensitive material)

Samples 101 to 112 prepared in the above were EACH exposed to white light for 0.5 seconds through an optical wedge and processed by the following amplifying developing process, Processing Procedure 1. The reflective density of each of the processed samples was measured with blue-, green- or red-light by a densitometer PDA-65, manufactured by Konica Corporation. The gradation of the sample amplifying developed for 60 seconds and that of the sample developed for 70 seconds were determined. The gradation was defined as the gradient of straight line connecting the point of a reflective density of 0.75 and the point of a reflective density of 1.75 on the characteristic curve. The ratio of the gradation measured by blue-light of the sample developed for 60 seconds to the gradation measured by green-light of the same sample, $Y_{60}/M_{60}$, and the similar value with respect to the sample developed for 70 seconds, $Y_{70}/M_{70}$, were determined. In the similar manner, the ratio of the gradation measured by red-light to the gradation measured by green-light in the sample developed for 60 seconds, $C_{60}/M_{60}$, and that in the sample developed for 70 seconds, $C_{70}/M_{70}$, were determined. The gradation of the sample developed for 60 seconds was assumed as a standard and the stability of balance of the gradation with respect to the fluctuation of the developing time was evaluated by the following values of Y/M and C/M. A smaller value correspondens to a higher stability of the gradation balance.

$$Y/M=|Y_{70}/M_{70}-Y_{60}/M_{60}|$$

$$C/M=|C_{70}/M_{70}-C_{60}/M_{60}|$$

On the other hand, a gray patch having a reflective density of 0.7 to 0.8 of each of the samples was prepared by controlling the exposure condition. The patch was subjected to visual evaluation of the visual coarseness of the image by 20 observers. The observers judged that the visual coarseness of the image of the patch was acceptable or not from the viewpoint of practical use. The result of the evaluation was expressed by the ratio of the observers who judged that the visual coarseness of the sample was acceptable in the 20 observers. Results of the evaluation were shown in Table 2.

Processing procedure 1

| Process | Treatment temperature | Time |
|---|---|---|
| Amplifying developer (CDA-1) | 33.0° ± 0.5° C. | 60 or 70 sec. |
| Bleach-fixer (BF-1) | 35.0° ± 0.5° C. | 20 sec. |
| Stabilizer | 30°–34° C. | 60 sec. |
| Drying | 60°–80° C. | 30 sec. |

The compositions of the processing solutions are shown below.

Amplifying developer CDA-1

Pure water 800 ml

Potassium bromide 0.001 g

Potassium chloride 0.35 g

N-ethyl-N-(βmethanesulfonamidoethyl)-3-methyl-4-aminoaniline sulfate 4.0 g

N,N-diethylhydroxylamine 4.7 g

Sodium diethylenetriaminepentaacetate 2.0 g 1-hydroxyethylidene-1,1'-disulfonic acid 0.35 g Fluorescent whitening agent (4,4'diamino-stylbenesulfonic acid derivative) 2.0 g Potassium carbonate 20 g Hydrogen peroxide (30% aqueous solution) 5.0 ml Water to make 1 l Adjust pH to 10.3

Bleach-fixer BF-1

Pure water 700 ml
Ferric ammonium diethylenetriamine-pentaacetate dihydrate 65 g
Diethylenetriaminepentaacetic acid 3 g
Ammonium thiosulfate (70% aqueous solution) 100 ml
2-amino-5-mercapto-1,3,4-thiadiazole 2.0 g
Ammonium sulfite (40% aqueous solution) 27.5 ml
Water to make 1 1
Adjust pH to 5.0 with potassium carbonate or acetic acid
Stabilizer
Pure water 800 ml
o-phenylphenol 1.0 g
5-chloro-2-methyl-4-isothiazoline-3-one 0.02 g
2-methyl-4-isothiazoline-3-one 0.02 g
Diethylene glycol 1.0 g
Fluorescent whitening agent (Tipanol SFP) 2.0 g
1-hydroxyethylidene-1,1'-diphosphonic acid 1.8 g
Bismuth chloride (45% aqueous solution) 0.65 g
Magnesium sulfate heptahydrate 0.2 g
PVP (polyvinylpyrrolydone) 1.0 g
Ammonia water (25% aqueous solution of ammonium hydroxide) 2.5 g
Trisodium nitrylotriacetate 1.5 g
Water to make 1 1
Adjust pH to 7.5 with sulfric acid or ammonia water.

TABLE 2

| Sample No. | Variation of gradation balance Y/M | C/M | Visual Coarse-ness | Remarks |
|---|---|---|---|---|
| 101 | 0.021 | 0.021 | 35 | Comparative |
| 102 | 0.009 | 0.006 | 40 | Comparative |
| 103 | 0.008 | 0.005 | 70 | Inventive |
| 104 | 0.007 | 0.007 | 75 | Inventive |
| 105 | 0.032 | 0.006 | 80 | Inventive |
| 106 | 0.021 | 0.104 | 75 | Comparative |
| 107 | 0.008 | 0.012 | 45 | Comparative |
| 108 | 0.017 | 0.115 | 80 | Comparative |
| 109 | 0.005 | 0.010 | 80 | Inventive |
| 110 | 0.033 | 0.008 | 95 | Inventive |
| 111 | 0.027 | 0.075 | 40 | Comparative |
| 112 | 0.006 | 0.024 | 0 | Comparative |

The results listed in Table 2 show that in each of Samples 101, 102, 107, 111 and 112, the ratio of the number of silver halide grain in the magenta image forming layer to that in the cyan image forming layer is not more than 1.5, and the ratio of the observers who accept the visual coarseness of the gray image is low. In Samples 106 and 108, the ratio of the number of silver halide grain in the magentnta image forming layer to that in the cyan image forming layer is not less than 2.1, and the ratio of the observers who accept the visual coarseness of the gray image is high in these light-sensitive materials. However, the gradation of cyan image and that of magenta image largely differs depending on the prolongation of the developing time and the object of the invention to reproduce a stable gradation balance cannot be attained in each of these light-sensitive materials. Contrary to that, it is understood that in Samples 103 to 105, 109 and 110 according to the invention, the ratio of the observer accepting the visual coarseness of the gray image is high and the stable gradation balance can be reproduced when the developing time is varied. Besides, in Samples 103, 104 and 109 each satisfying the preferable conditions of the invention, the difference between the gradation of each of the color forming layers is small and the effect of the invention to make satable the gradation balance with respect to the fluctuation in the developing time, is particularly enhanced.

Example 2

Samples 201 and 202, 203 and 204, and 205 and 206 were prepared in the same manner as in samples 101, 104 and 109, respectively, except that cyan coupler C-3 or C-4 were used in place of cyan coupler C-1. The light-sensitive materials were evaluated in the same manner as in Example 1. Results of the evaluation are listed in Table 3.

TABLE 3

| Sample No. | Base alight-sensitive material | Cyan coupler | Variation of gradation balance Y/M | C/M | Visual coarse-ness | Remarks |
|---|---|---|---|---|---|---|
| 101 | 101 | C-1 | 0.021 | 0.021 | 35 | Comp. |
| 201 | 101 | C-3 | 0.022 | 0.019 | 35 | Comp. |
| 202 | 101 | C-4 | 0.022 | 0.021 | 30 | Comp. |
| 104 | 104 | C-1 | 0.007 | 0.007 | 75 | Inv. |
| 203 | 104 | C-3 | 0.004 | 0.004 | 85 | Inv. |
| 204 | 104 | C-4 | 0.005 | 0.008 | 90 | Inv. |
| 109 | 109 | C-1 | 0.005 | 0.010 | 80 | Inv. |
| 205 | 109 | C-3 | 0.004 | 0.008 | 90 | Inv. |
| 206 | 109 | C-4 | 0.005 | 0.008 | 90 | Inv. |

It is understood from the results in Table 3 that in Samples 203 to 206, which satisfy the requirements of the invention and contain a cyan coupler having an imidazole nucleus or a pyrazoloazole nucleus in the cyan image forming layer thereof, the effect on the improvement in the visual coarseness of the gray image is larger than that in Samples 104 and 109 containing the cyan coupler having a phenol nucleus. The dye formed from the couple having the imidazole nucleus or a pyrazoloazole nucleus has a sharp spectral on.

Example 3

(Preparation of blue-sensitive silver halide emulsion)

A monodisperse cubic emulsion EMP-31A having an average diameter of 0.50 μm and a silver chloride content of 99.5 mole-%, and a monodisperse cubic emulsion EMP-31B having an average diameter of 0.45 μm and a silver chloride content of 99.5 mole-% were prepared in the same manner as in the silver halide emulsion EMP-11A except that the time for addition of Solution A1 and Solution B1, and that of Solution C1 and Solution D1 were changed.

The above-mentioned EMP-31A and EMP-31B were optimally sensitized in a manner similar to that in EMP-1A and EMP-1B, respectively. Sensitized EMP-31A and EMP-31B were mixed in a ratio of 1:1 to obtain a blue-sensitive silver halide emulsion Em-B2.

(Preparation of green-sensitive silver halide emulsion)

A monodisperse cubic emulsion EMP-41A having an average diameter of 0.34 μm and a silver chloride content of 99.5 mole-%, and a monodisperse cubic emulsion EMP-41B having an average diameter of 0.39 μm and a silver chloride content of 99.5 mole-% were prepared in the same manner as in the silver halide emulsion EMP-11A except that the time for addition of Solution A1 and Solution B1, and that of Solution C1 and Solution D1 were changed.

The above-mentioned EMP-41A and EMP-41B were optimally sensitized in a manner similar to that in EMP-1A and EMP-1B, respectively. Sensitized EMP-41A and EMP-41B were mixed in a ratio of 1:1 to obtain a blue-sensitive silver halide emulsion Em-G2.

A green-sensitive emulsion Em-G3 was prepared in the same manner as in the green-sensitive emulsion Em-G2 except that EMP-31A and EMP-31B were used in place of EMP-41A and EMP-41B, respectively.

(Preparation of red-sensitive silver halide emulsion)

A red-sensitive silver halide emulsion Em-R2 was prepared in the same manner as in the red-sensitive silver halide emulsion Em-R1 except that EMP-21A and EMP-21B were replaced by EMP-1A and EMP-1B, respectively. Besides, a red-sensitive silver halide emulsion Em-R3 was prepared in the same manner as in the red-sensitive silver halide emulsion Em-R1 except that EMP-21A and EMP-21B were replaced by EMP-41A and EMP-41B, respectively.

(Preparation of Samples)

Samples 301 through 313 were prepared in the same manner as in Sample 101 except that the kind of silver halide emulsion and the amount of silver halide in each of the light-sensitive materials were changed as shown in Table 4.

TABLE 4

| Sample No. | Kind of silver halide 1st layer | 3rd layer | 5th layer | Amount & ratio of silver halide Total mg/m$^2$ | QY/QM | QY/QM | Ratio of number of silver halide grains NM/NC | NM/NY | Remarks |
|---|---|---|---|---|---|---|---|---|---|
| 301 | Em-B1 | Em-G3 | Em-R3 | 49.0 | 1.56 | 2.07 | 0.91 | 1.84 | Comp. |
| 302 | Em-B1 | Em-G3 | Em-R3 | 68.0 | 1.40 | 3.13 | 1.43 | 2.05 | Comp. |
| 303 | Em-B1 | Em-G3 | Em-R3 | 73.1 | 1.17 | 3.75 | 1.71 | 2.46 | Inv. |
| 304 | Em-B1 | Em-G3 | Em-R3 | 92.9 | 1.83 | 3.75 | 1.71 | 1.56 | Inv. |
| 305 | Em-B1 | Em-G3 | Em-R3 | 78.0 | 1.00 | 4.38 | 2.00 | 2.87 | Inv. |
| 306 | Em-B1 | Em-G3 | Em-R3 | 98.0 | 1.25 | 5.00 | 2.28 | 2.30 | Comp. |
| 307 | Em-B2 | Em-G3 | Em-R3 | 51.0 | 1.39 | 2.25 | 1.03 | 0.72 | Comp. |
| 308 | Em-B2 | Em-G3 | Em-R3 | 59.1 | 0.96 | 3.25 | 1.48 | 1.04 | Comp. |
| 309 | Em-B1 | Em-G2 | Em-R3 | 48.0 | 1.67 | 1.88 | 1.88 | 3.77 | Inv. |
| 310 | Em-B1 | Em-G2 | Em-R3 | 63.0 | 1.75 | 2.50 | 2.50 | 3.59 | Comp. |
| 311 | Em-B1 | Em-G2 | Em-R3 | 97.1 | 5.36 | 1.75 | 1.75 | 1.17 | Inv. |
| 312 | Em-B1 | Em-G3 | Em-R2 | 50.0 | 2.63 | 0.63 | 1.82 | 1.09 | Inv. |
| 313 | Em-B1 | Em-G3 | Em-R2 | 60.0 | 3.68 | 0.63 | 1.82 | 0.78 | Comp. |

Samples 301 through 313 were evaluated in the same manner as in Example 1. Evaluation results are listed in Table 5.

TABLE 5

| Sample No. | Fluctuation in gradation balance Y/M | C/M | Visual coarse-ness | Remarks |
|---|---|---|---|---|
| 301 | 0.016 | 0.015 | 30 | Comparative |
| 302 | 0.017 | 0.012 | 35 | Comparative |
| 303 | 0.026 | 0.012 | 75 | Inventive |
| 304 | 0.004 | 0.008 | 90 | Inventive |
| 305 | 0.012 | 0.028 | 80 | Inventive |
| 306 | 0.024 | 0.224 | 75 | Comparative |
| 307 | 0.015 | 0.014 | 20 | Comparative |
| 308 | 0.024 | 0.082 | 35 | Comparative |
| 309 | 0.028 | 0.015 | 80 | Inventive |
| 310 | 0.024 | 0.168 | 75 | Comparative |
| 311 | 0.020 | 0.008 | 85 | Inventive |
| 312 | 0.012 | 0.033 | 80 | Inventive |
| 313 | 0.006 | 0.042 | 25 | Comparative |

It is understood from Table 5 that the number of silver halide grains in the magenta image forming layer is not largest in comparison with the other color forming layers in Samples 307 and 313, and the ratio of the number of silver halide grains in the magenta image forming layer to that in the cyan image forming layer is not more than 1.5 in Samples 301, 302 and 308. The ratio of the observers who accept the visual coarseness of the gray image formed on these light-sensitive materials is low.

With respect to Samples 306 and 310 each having a ratio of the number of silver halide grains in the magenta image forming layer to that in the cyan image forming layer of not less than 2.1, the ratio of observers who accept the visual coarseness of gray image is high. However, the difference between the gradation of cyan magenta and that of magenta image caused by the prolongation of the developing time is large in each of these light-sensitive materials, and the effect of the invention to reproduce a stable gradation balance with respect to the fluctuation of the amplifying developing time cannot be attained.

In Samples 303, 304, 309 and 311 each of which has a ratio of the amount of silver halide in the magenta image forming layer to that in the cyan image forming layer is within the range of not less than 0.9, the difference between the gradation of the cyan image and that of the magenta image caused by the difference of the amplifying developing time is small and the gradation balance can be stably reproduced even when the amplifying development time is fluctuated.

In Samples 304, 305 and 312, in each of which the ratio of the amount of silver halide in the yellow image forming layer to that in the magenta image forming layer is within the range of from 1.8 to 5, the difference between the yellow image and the magenta imge caused by the difference of the amplifying develping time is small and the gradation balance can be stably reproduced when the amplifying developing time is fluctuated. It is understood that the ratio of observers who accept the visual coarseness of gray image is high with respect to Sample 304 fully satisfying the preferable conditions of the invention, and the effect of the invention to reproduce a stable gradation balance with respect to the fluctuation of the amplifying developing time is enhanced in this light-sensitive material.

Example 4

(Preparation of green-sensitive silver halide emulsion Em-G4)

A monodisperse cubic emulsion EMP-51A having an average diameter of 0.21 $\mu$m and a silver chloride content of 99.5 mole-%, was prepared in the same manner as in the silver halide emulsion EMP-1A the except that the time for addition of Solution A1'and Solution B1, and that of Solution C1 and Solution D1 were changed. The emulsion Em-51A was chemically sensitized optimally at 60° C. using the same compounds as in the preparation of the green-sensitive emulsion Em-G1 in Example 1 to prepare a green sensitive emulsion Em-G4.

(Preparation of red-sensitive silver halide emulsion Em-R4)

A monodisperse cubic emulsion EMP-52A having an average diameter of 0.23 μm and a silver chloride content of 99.5 mole-%, was prepared in the same manner as in the silver halide emulsion EMP-1A except that the time for addition of Solution A1 and Solution B1, and that of Solution C1 and Solution D1 were changed. The emulsion Em-52A was chemically sensitized optimally at 60° C. using the same compounds as in the preparation of the red-sensitive emulsion Em-R1 in Example 1 to prepare a red-sensitive emulsion Em-R4.

(Preparation of blue-sensitive silver halide emulsion Em-B4)

A monodisperse cubic emulsion EMP-53A having an average diameter of 0.26 μm and a silver chloride content of 99.5 mole-%, was prepared in the same manner as in the silver halide emulsion EMP-1A except that the time for addition of Solution A1 and Solution B1, and that of Solution C1 and Solution D1 were changed. The emulsion Em-53A was chemically sensitized optimally at 60° C using the same compounds as in the preparation of the blue-sensitive emulsion Em-B1 in Example 1 to prepare a blue-sensitive emulsion Em-B4.

(Preparation of Samples 401 through 404)

Samples 401 through 404 were prepared in the same manner as in Sample 101 in Example 1 except that the emulsions in the first, third and fifthe layers were replaced with Em-B4, Em-G4 and Em-R4, respectively, and the amount of silver halide was changed as shown in Table 6.

Samples 401 to 404, and Samples 103, 104, 109 and 110 prepared in Example 1 were each exposed to white light for 0.5 seconds through an optical wedge and processed by the following Processing Procedure 2. The processed samples were subjected to densitometry with green light by Densitometer PDA-65, manufactured by Konica Corporation, to determine the minimum density $D_{min}S$ and the gradation γS of each the samples. The definition of the gradation is the same as that in Example 1. On the other hand, the exposed samples were processed in the same manner as the above-mentioned except that the amount of hydrogen peroxide in the amplifying developer CDA-2 was changed to 50 ml. The minumum density $D_{min}O$ and the gradation γO of thus processed sampes were detemined. The stability of the gradation reproduction was evaluated by a ratio of γO/γS which indicated the variation of the gradation caused by the change of the concentration of hydrogen peroxide in the amplifying developer when the γS was assumed as a standard. A value of γO/γS nearer 1 indicates a smaller degree of variation in the gradation caused by the change in the hydrogen peroxide concentration, so a sample showing such the value is preferable. Values of γO/γS of the samples are listed in Table 7 together with values $Q/r^3$ in the third layer of the samples.

Processing procedure 2

| Processing | Temperature | Time |
|---|---|---|
| Amplifying developer (CDA-2) | 35.0 ± 0.5° C. | See Table 3 |
| Bleach-fixer (BF-1) | 30.0 ± 0.5° C. | 45 seconds |
| Stabilizer | 30 to 34° C. | 60 seconds |
| Drying | 60 to 80° C. | 30 seconds |

Compositions of the processing solutions are as follows.

Amplifying developer (CDA-2)

Pure water 800 ml
Potassium bromide 0.001 g
Potassium chloride 0.35 g
N-ethyl-N-(β-methanesulfonamideethyl)-3-methyl-4-aminoaniline sulfate 4.0 g
N,N-diethylhydroxylamine 4.7 g
Hydroxylamine sulfate 1.0 g
Sodium ethylenetriaminepentaacetate 2.0 g
1-hydroxyethylidene-1,1'-disulfonic acid 0.35 g
Fluorescent whitening agent (4,4-diamino- stylbene derivative) 2.0 g
Disodium hydrogen phosphate 10 g
Potassium carbonate 20 g
Hydrogen peroxide (5.99%) 25 ml Adjust pH to 11.0 with potassium hydroxide or sulfuric acid and make to 1 1 by water.

TABLE 6

| Sample No. | Amount of silver halide ($g/m^2$) 1st layer | 3nd layer | 5th layer | Ratio of silver halide amount QY/QM | QM/QC | Ratio of number of silver halide grains NM/NC | NM/NY | Remarks |
|---|---|---|---|---|---|---|---|---|
| 401 | 0.014 | 0.010 | 0.008 | 1.40 | 1.25 | 1.64 | 1.36 | Inv. |
| 402 | 0.036 | 0.022 | 0.018 | 1.64 | 1.22 | 1.61 | 1.16 | Inv. |
| 403 | 0.030 | 0.070 | 0.045 | 0.43 | 1.56 | 2.04 | 4.43 | Inv. |
| 404 | 0.040 | 0.060 | 0.040 | 0.67 | 1.50 | 1.97 | 2.85 | Inv. |

TABLE 7

| Sample No. | $Q/r^3$ | γO/γS | Remarks |
|---|---|---|---|
| 103 | 0.22 | 1.29 | Inventive |
| 104 | 0.29 | 1.13 | Inventive |
| 109 | 0.14 | 1.28 | Inventive |
| 110 | 0.43 | 1.14 | Inventive |
| 401 | 1.08 | 1.08 | Inventive |
| 402 | 2.38 | 1.08 | Inventive |
| 403 | 7.56 | 1.28 | Inventive |
| 404 | 6.48 | 1.14 | Inventive |

In Examaple 4, the samples in which the value of $Q/r^3$ was changed by controlling the average diameter of silver halide grains and the amount of silver halide, were prepared and evaluated. It is understood from the results listed in Table 7 that in each of the samples satisfying the requirement of the invention that the value of $Q/r^3$ is within the range of 0.27 to 7.4, the value of γO/γS is near 1 and the variation of the quality of the printed image is small when the sate of the amplifyinge developer is fluctuated. In Samples 401 and 402 each having a $Q/r^3$ value within the range of 0.56 to 2.7, the value of γO/γS is particularly near 1, and it is understood that such the condition is a preferable embodiment of the invention.

Example 5

(Preparation of Samples 501 to 512)

Samples 501 through 512 were prepared in the same manner as in samples 401 to 404 except that the pH value of the coating liquid of the second layer was controlled by sulfric acid or sodium hydroxide so that the pH value of the photographic layer was adjusted to that shown in Table 8. Samples 501 to 512 were evaluated in the same manner as in Example 4. Results of the evaluation are listed in Table 8 together with the values of $Q/r^3$ of the samples.

TABLE 8

| Sample NO. | pH of photographic layer | $Q/r^3$ | Variation of gradation γO/γS | Remarks |
|---|---|---|---|---|
| 401 | 5.8 | 1.08 | 1.08 | Inventive |
| 501 | 4.3 | 1.08 | 1.12 | Inventive |
| 502 | 6.3 | 1.08 | 1.07 | Inventive |
| 503 | 6.8 | 1.08 | 1.13 | Inventive |
| 402 | 5.8 | 2.38 | 1.08 | Inventive |
| 504 | 4.3 | 2.38 | 1.13 | Inventive |
| 505 | 6.3 | 2.38 | 1.10 | Inventive |
| 506 | 6.8 | 2.38 | 1.15 | Inventive |
| 403 | 5.8 | 7.56 | 1.28 | Inventive |
| 507 | 4.3 | 7.56 | 1.31 | Inventive |
| 508 | 6.3 | 7.56 | 1.27 | Inventive |
| 509 | 6.8 | 7.56 | 1.32 | Inventive |
| 404 | 5.8 | 6.48 | 1.14 | Inventive |
| 510 | 4.3 | 6.48 | 1.16 | Inventive |
| 511 | 6.3 | 6.48 | 1.14 | Inventive |
| 512 | 6.8 | 6.48 | 1.17 | Inventive |

In Example 5, the samples different in the pH value of the photographic layer were prepared and evaluated. It is understood from the results listed in Table 8 that the values of γO/γ the samples having a pH value of the photographic layer within the range 4.5 to 6.5 are particularly near 1 and the variation in the quality of the printed image is small when the state of the amplifying developer is fluctuated even when the samples have the same $Q/r^3$ value. Accordingly, it is understood that such the condition is a preferable embodiment of the invention.

Example 6

Sample 402 prepared in Example 4 was exposed and processed in the same manner as in Example 4 except that in the amplifying developer CDA-2, the pH value is changed as shown in Table 9 and hydroxylamine sulfate (BW-1) was replaced by a black-and-white developing agent L-ascorbic acid (BW-2) or hydroquinone (BW-3), and the developing time is changed to 30 seconds. The processed sample were subjected to densitometry with blue light by the densitometer PDA-65 to determine the maximum density and minimum density of each of the sample. The resuls are listed in Table 9.

TABLE 9

| Experimen No. | pH | Black-and-white developing agent Kind | Amount (g/l) | $D_{max}$ | $D_{min}$ | Remarks |
|---|---|---|---|---|---|---|
| 601 | 10.0 | BW-1 | 1.0 | 1.12 | 0.06 | Inventive |
| 602 | 10.7 | BW-1 | 1.0 | 1.44 | 0.06 | Inventive |
| 603 | 11.0 | BW-1 | 1.0 | 1.47 | 0.07 | Inventive |
| 604 | 11.6 | BW-1 | 1.0 | 1.48 | 0.07 | Inventive |
| 605 | 12.4 | BW-1 | 1.0 | 1.50 | 0.14 | Inventive |
| 606 | 11.0 | — | — | 1.37 | 0.07 | Inventive |
| 607 | 11.0 | BW-1 | 2.0 | 1.48 | 0.07 | Inventive |
| 608 | 11.0 | BW-2 | 1.0 | 1.49 | 0.07 | Inventive |
| 609 | 11.0 | BW-2 | 2.0 | 1.50 | 0.07 | Inventive |
| 610 | 11.0 | BW-3 | 1.0 | 1.47 | 0.07 | Inventive |
| 611 | 11.0 | BW-3 | 2.0 | 1.48 | 0.07 | Inventive |

In Example 6, the pH value, and the kind and amount of the black-and-white developing agent in the amplifying developer were echanged. It is understood from comparison of the results of Experiments 601 to 605 that a high maximum density and a low minimum density can be obtained at the same time and the developing time can be shortened when the pH value of the amplifying developer satisfies the preferable condition of the invention that the pH value of the developer is within the range of 10.5 to 12.0. Futhermore, it is understood from comparison of the results of experiments 603 and 606 through 611 that a high maximum density can be obtained without increasing in the minimum density and the developing time can be shortened when the amplifying development is carried out in the presence of the black-and-white dveloping agent. Accordingly it is understood that such the condition is a preferable embodiment of the invention.

What is claimed is:

1. An image forming method comprising imagewise exposing to light a silver halide photographic material comprising a support having thereon a photographic layer including a yellow image forming silver halide emulsion layer, a magenta image forming silver halide emulsion layer and a cyan image forming silver halide emulsion layer, and developing said silver halide photographic light-sensitive material with an amplifying development, wherein silver halide grains in each of said yellow image forming silver halide emulsion layer, magenta image forming silver halide emulsion layer and said cyan image forming silver halide emulsion layer have a silver chloride content of not less than 80 mole-%, and the number of silver halide grains per unit area in said magenta silver halide emulsion layer is larger than that in said yellow image forming silver halide emulsion layer and that in said cyan image forming silver halide emulsion layer, the number of silver halide grains per unit area in said magenta image forming silver halide emulsion is 1.5 to 2.1 times that in said cyan image forming silver halide emulsion layer, and the total amount of silver halide in said yellow image forming emulsion layer, magenta image forming silver halide emulsion layer and cyan image forming silver halide emulsion layer is silver.

2. The method of claim 1, wherein the amount of silver halide per unit area in said magenta image forming silver halide emulsion layer is 0.9 to 4 times amount of silver halide per unit area in said cyan image forming silver halide emulsion layer.

3. The method of claim 1, wherein the amount of silver halide per unit area in said yellow image forming silver halide emulsion layer is 1.8 to 5 times amount of silver halide per unit area in said magenta image forming silver halide emulsion layer.

4. The method of claim 1, wherein the following equation 5 is satisfied in at least one of said yellow image forming silver halide emulsion layer, magenta image forming silver halide emulsion layer and cyan image forming silver halide emulsion layer;

Equation 5

$$7.4 \geqq Q/r^3 \geqq 0.27$$

wherein Q is the amount of silver halide contained in said at least one silver halide emulsion layer in $g/m^2$ in terms of silver, and r is the average diameter of silver halide grains contained in said silver halide emulsion layer in $\mu m$.

5. The method of claim 4, wherein said silver halide emulsion layer in which Equation 5 is satisfied is said magenta image forming silver halide emulsion layer or said cyan image forming silver halide emulsion layer.

6. The method of claim 5, wherein said silver halide emulsion layer in which Equation 5 is satisfied is said magenta image forming silver halide emulsion layer.

7. The method of claim 1, wherein the pH value of said photographic layer is 4.5 to 6.5.

8. The method of claim 1, wherein said amplifying development is carried out in the presence of a black-and-white developing agent.

9. The method of claim 1, wherein said amplifying development is carried out under a condition having a pH value of 10.5 to 12.0.

* * * * *